US005353469A

United States Patent [19]

Fellhauer

[11] Patent Number: 5,353,469

[45] Date of Patent: Oct. 11, 1994

[54] WET/DRY VACUUM CLEANER WITH NOISE REDUCING HOUSING STRUCTURE

[75] Inventor: Jeffery R. Fellhauer, Toledo, Ohio

[73] Assignee: National Super Service Company, Toledo, Ohio

[21] Appl. No.: 907,237

[22] Filed: Jul. 1, 1992

[51] Int. Cl.[5] ..... A47L 9/00

[52] U.S. Cl. ..... 15/326; 15/327.6; 15/353

[58] Field of Search ..... 15/326, 327.6, 353

[56] References Cited

U.S. PATENT DOCUMENTS

| | | | |
|---|---|---|---|
| 2,327,553 | 8/1943 | Ponselle . | |
| 2,884,185 | 4/1959 | Dolan . | |
| 2,962,118 | 11/1960 | Lee et al. | 15/326 X |
| 3,290,865 | 12/1966 | Serou et al. | 15/353 X |
| 3,609,946 | 10/1971 | Nakagawa et al. . | |
| 3,842,461 | 10/1974 | Wurster . | |
| 3,874,023 | 4/1975 | Tschudy . | |
| 4,280,245 | 7/1981 | Hiester . | |
| 4,307,483 | 12/1981 | House . | |
| 4,330,899 | 5/1982 | Miller et al. . | |
| 4,334,337 | 6/1982 | Miller et al. . | |
| 4,356,591 | 11/1982 | Lude | 15/326 |
| 4,418,443 | 12/1983 | Fischer . | |
| 4,435,877 | 3/1984 | Berfield . | |
| 4,443,235 | 4/1984 | Brenholt et al. . | |
| 4,651,380 | 3/1987 | Ogden . | |
| 4,665,581 | 5/1987 | Oberdorfer . | |
| 4,706,326 | 11/1987 | Romani . | |
| 4,733,429 | 3/1988 | Jacob et al. . | |
| 4,759,422 | 7/1988 | Belley . | |
| 4,773,118 | 9/1988 | Lindquist et al. . | |
| 4,797,072 | 1/1989 | Berfield et al. . | |
| 4,938,309 | 7/1990 | Emdy . | |
| 5,068,555 | 11/1991 | Oberdorfer-Bogel . | |

*Primary Examiner*—Chris K. Moore

*Attorney, Agent, or Firm*—MacMillan, Sobanski & Todd

[57] ABSTRACT

A floor cleaning device, such as a wet/dry vacuum cleaner, is disclosed having a housing structure which reduces the amount of ambient noise generated thereby. The floor cleaning device includes a float stand which is preferably formed from a single piece of material, such as rotationally cast polyethylene. The float stand is adapted to be mounted on a canister or tank. A hollow lid is mounted on the float stand. The lid is also preferably formed from a single piece of material. A plurality of chambers of varying size are defined within the lid. A blower motor assembly is supported within the hollow lid. When the blower motor assembly is activated, air flows into the canister and through the various annular chambers before being discharged to the atmosphere. The varying sizes of the chambers provides a significant reduction in the amount of ambient noise generated by the floor cleaning device during use. The overall structure of the floor cleaning device is compact and easy to assemble.

12 Claims, 4 Drawing Sheets

WET/DRY VACUUM CLEANER WITH NOISE REDUCING HOUSING STRUCTURE

BACKGROUND OF THE INVENTION

This invention relates in general to floor cleaning equipment and in particular to a wet/dry vacuum cleaner having an improved housing structure which reduces the amount of ambient noise generated thereby.

Vacuum cleaners are well known devices which are employed for cleaning floor surfaces. Such vacuum cleaners create a suction effect which can draw air, water, and other materials into a canister for collection and subsequent disposal. This is typically accomplished by an electric motor which rotatably drives a fan. Rotation of the fan by the motor causes air to move through a housing. Within the housing, dirt, water, and other materials are separated from the air flow and deposited in the canister. Many different vacuum cleaner structures are known in the art.

One common drawback to known vacuum cleaners is that they are somewhat noisy. High noise levels have been found to be bothersome to those using the vacuum cleaners. Some known vacuum cleaners are provided with structures which reduce the amount of noise generated thereby. Typically, this has been accomplished by reducing the velocity of the air exiting from the housing or by passing the air through a tortuous path within the housing. However, known noise reducing structures in vacuum cleaners have been relatively complicated, requiring additional expense in parts or assembly labor. Thus, it would be desirable to provide an improved housing structure for a vacuum cleaner which reduces the amount of ambient noise generated thereby, yet which is relatively simple and inexpensive in construction.

SUMMARY OF THE INVENTION

This invention relates to a floor cleaning device, such as a wet/dry vacuum cleaner, having an improved housing structure which reduces the amount of ambient noise generated thereby. The floor cleaning device includes a float stand which is preferably formed from a single piece of material, such as rotationally cast polyethylene. The float stand is adapted to be mounted on a canister or tank. A hollow lid is mounted on the float stand. The lid is also preferably formed from a single piece of material. A plurality of chambers of varying size are defined within the lid. A blower motor assembly is supported within the hollow lid. When the blower motor assembly is activated, air flows into the canister and through the various annular chambers before being discharged to the atmosphere. The varying sizes of the chambers provides a significant reduction in the amount of ambient noise generated by the floor cleaning device during use. The overall structure of the floor cleaning device is compact and easy to assemble.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
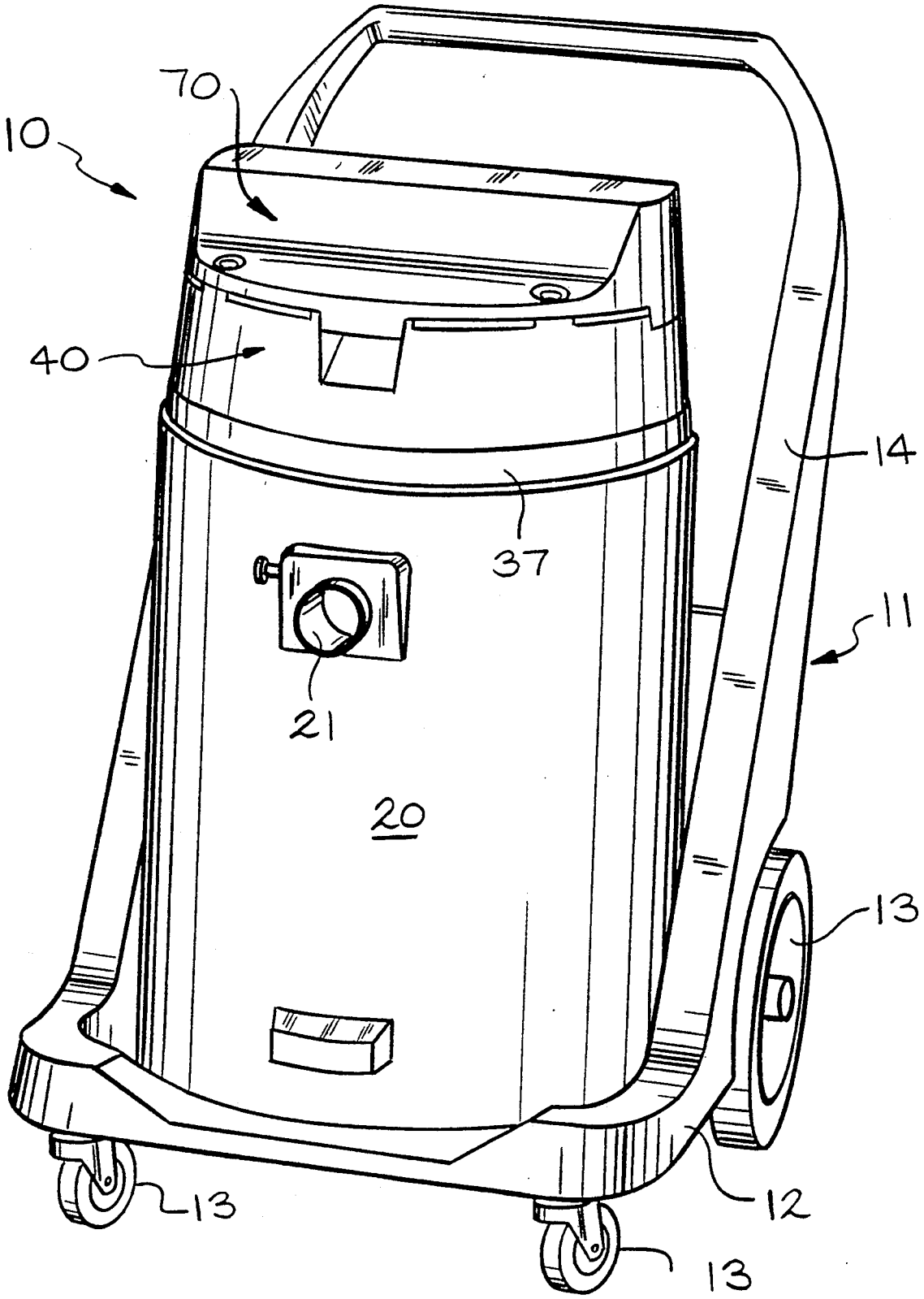
FIG. 1 is a perspective view of a floor cleaning device having an improved housing structure in accordance with this invention.

Referring now to the drawings, there is illustrated in FIG. 1 a floor cleaning device, indicated generally at 10, having an improved housing structure in accordance with this invention. This invention will be described and illustrated in the context of a wet/dry vacuum cleaner, i.e., a vacuum cleaner which is adapted for use in removing both wet and dry materials from a floor surface. However, it will be appreciated that this invention may be used in conjunction with other known floor cleaning devices. The floor cleaning device 10 may be mounted on a cart, indicated generally at 11, for convenient use. The cart 11 includes including a base portion 12 for supporting the floor cleaning device 10, a plurality of wheels and casters 13 for facilitating movement of the cart 11 and the floor cleaning device 10, and a handle portion 14 extending upwardly from the base portion 12. If desired, the floor cleaning device 10 may be pivotably connected to the handle portion 14 of cart 11 to facilitate emptying of the device 10 after use.

Figure 2:
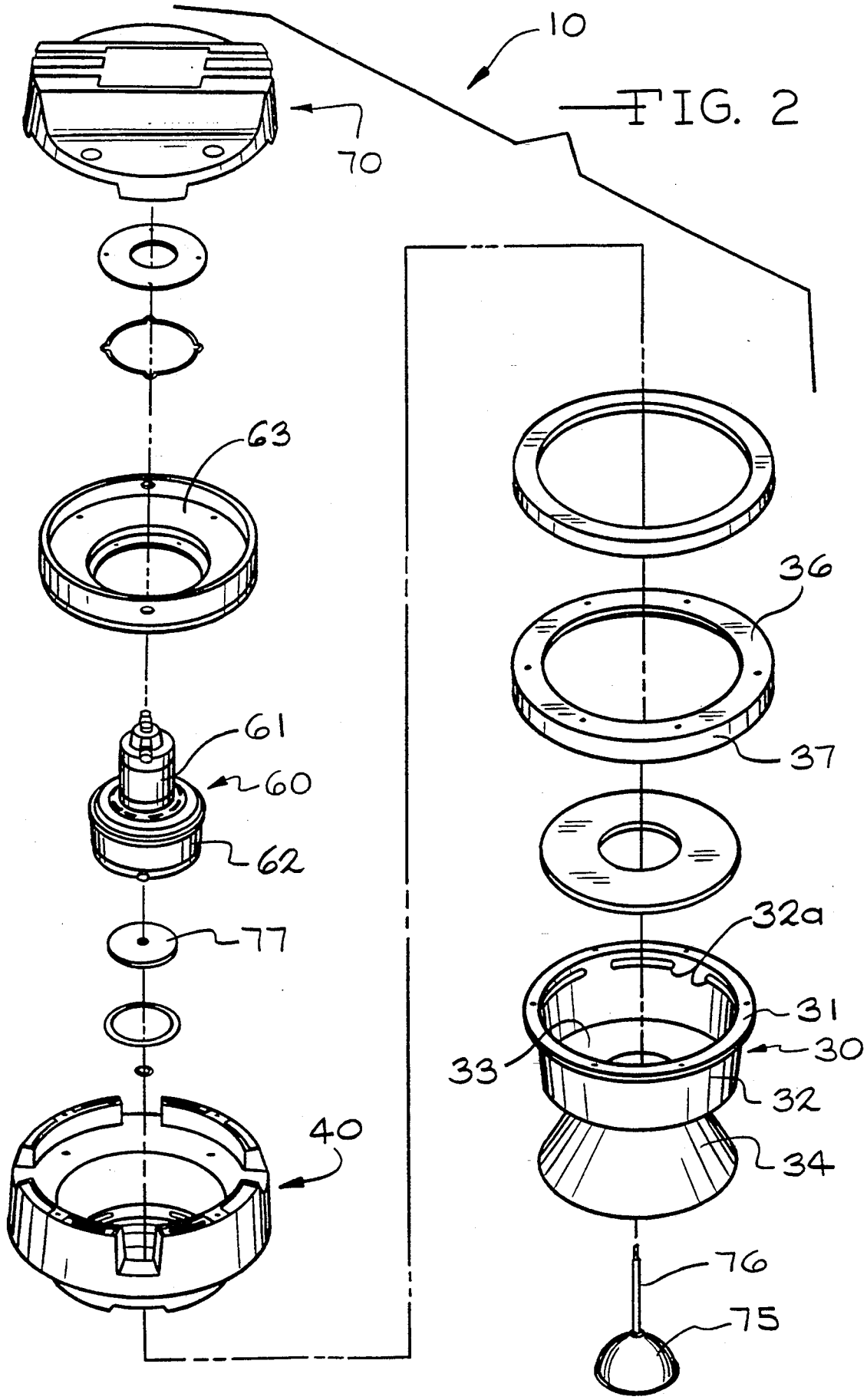
FIG. 2 is an exploded perspective view of the floor cleaning device of FIG. 1.
Figure 3:
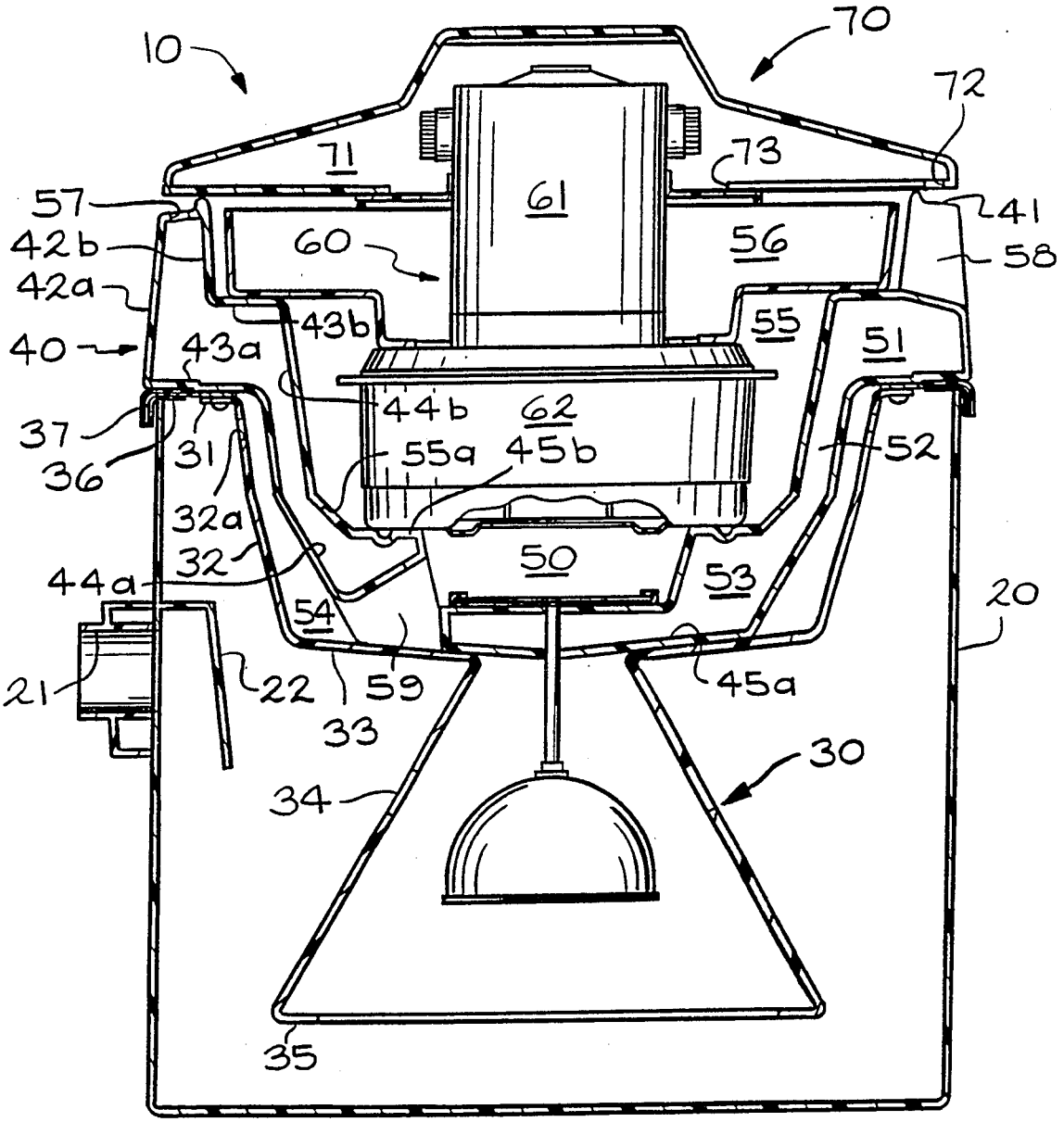
FIG. 3 is a sectional side elevational view of the assembled floor cleaning device taken along line 3—3 of FIG. 4.
Figure 4:
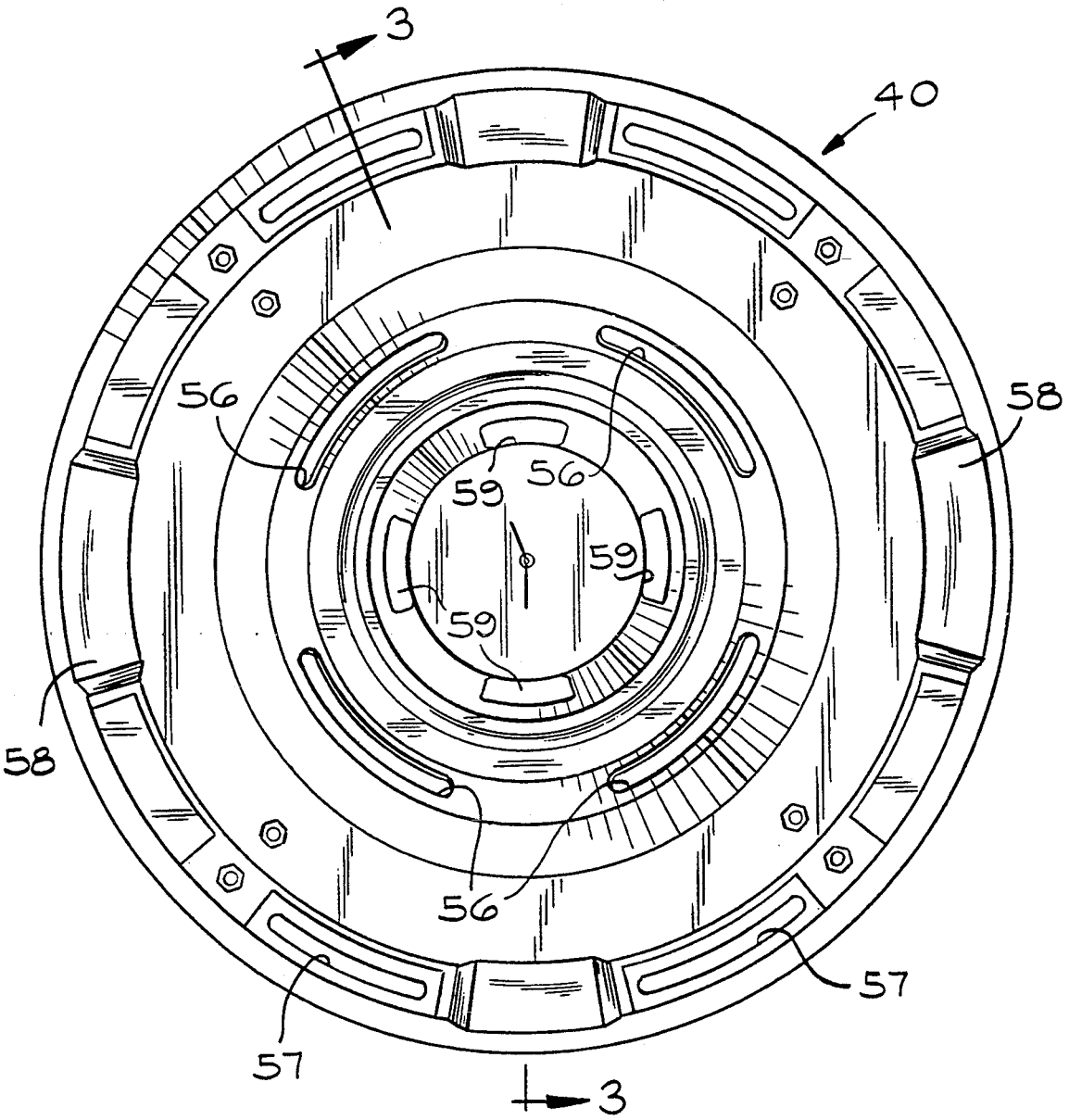
FIG. 4 is a top plan view of the float stand of the floor cleaning device shown in FIGS. 2 and 3.

Referring now to FIGS. 2 through 4, the structure of the floor cleaning device 10 is illustrated in detail. The floor cleaning device 10 is mounted on a hollow cylindrical canister or tank 20 having closed lower end and an opened upper end. The canister 20 may be formed from a single piece of material, such as rotationally cast polyethylene. Alternatively, the canister 20 may be formed from stainless steel. A suction opening 21 is formed in the side wall of the canister 20. As will be described in detail below, operation of the floor cleaning device 10 creates a vacuum effect within the canister 20 which can draw air, water, and other materials through the suction opening 21 into the canister 20 for collection and subsequent disposal. A conventional flexible hose and tool assembly (not shown) can be attached to the suction opening 21 for use. A deflector 22 may be provided within the canister 20 to deflect the flow of incoming air passing through the suction opening 21 downwardly toward the closed end thereof. The deflector 22 facilitates the separation of the dirt, water, and other materials from the incoming air flow.

Within the canister 20, a float stand, indicated generally at 30, is disposed. The float stand 30 is preferably formed from a single piece of material, such as rotationally cast polyethylene. The float stand 30 includes an upper flange portion 31 having a generally cylindrical upper body portion 32 depending from the inner edge thereof. As best shown in FIG. 3, the upper body portion 32 may taper slightly from a larger diameter upper end to a smaller diameter lower end. A plurality of slots **32*a* are formed through the upper end of the upper body portion 32 at spaced intervals. The purpose of these slots 32*a*** will be described in detail below.

An intermediate flange portion 33 extends inwardly from the lower end of the upper body portion 32. A generally frusto-conical lower body portion 34 extends downwardly from the inner edge of the intermediate flange portion 33. The lower body portion 34 tapers from a smaller diameter upper end to a larger diameter lower end. A lower flange portion 35 extends inwardly from the lower end of the lower body portion 34.

The upper flange portion 31 of the float stand 30 is secured to a support ring 36 by a plurality of conventional threaded fasteners (not shown). The support ring 36 extends outwardly from the outer edge of the upper flange portion 31 to a downwardly depending lip 37. The support ring 36 is sized to fit over the upper opened end of the canister 20. As best shown in FIG. 3, the depending lip 37 of the support ring 36 extends relatively snugly about such upper opened end. Thus, the float stand 30 and the support ring 36 are securely supported on the canister 20 for use, yet can be easily removed therefrom when it is desired to empty the canister.

Within the upper body portion 32 of the float stand 30, a hollow lid, indicated generally at 40, is disposed. The lid 40 is also preferably formed from a single piece of material, such as rotationally cast polyethylene. The lid 40 includes an upper end surface 41 which is generally annular in shape. A first outer surface 42*a* and a first inner surface 42*b* depend downwardly from the outer and inner edges of the upper end surface 41. The surfaces 42*a* and 42*b* are generally cylindrical in shape and generally parallel to one another. A second outer surface 43*a* and a second inner surface 43*b* extend inwardly from the lower ends of the surfaces 42*a* and 42*b*, respectively. The surfaces 43*a* and 43*b* extend generally parallel to one another.

Similarly, a third outer surface 44*a* and a third inner surface 44*b* depend downwardly from the inner edges of the surfaces 43*a* and 43*b*, respectively. The surfaces 44*a* and 44*b* are generally cylindrical in shape and extend generally parallel to one another. Lastly, a fourth outer surface 45*a* and a fourth inner surface 45*b* extend inwardly from the lower ends of the surfaces 44*a* and 44*b*, respectively. The surfaces 45*a* and 45*b* extend generally parallel to one another. An inner portion of the fourth inner surface 45*b* may be recessed to form a generally cylindrical inlet 50, the purpose of which will be explained below.

The hollow interior of the float stand 40 is generally divided into a plurality of annular chambers. A first annular chamber 51, is defined near the upper end of the float stand 30 by the surfaces 41, 42*a*, 42*b*, 43*a*, and 43*b*. A second annular chamber 52 is defined in the intermediate portion of the float stand 40 by the surfaces 44*a* and 44*b*. Lastly, a third annular chamber 53 is defined near the lower end of the float stand 40 by the surfaces 45*a* and 45*b*. As shown in FIG. 3, the sizes of the upper and lower annular chambers 51 and 53 are somewhat larger in volume than the intermediate annular chamber 52. The purpose of these annular chambers 51, 52, and 53 will be explained below.

When installed as shown in FIG. 3, the second outer surface 43*a* of the lid 40 abuts and is supported by the upper flange 31 of the float stand 30 and by the support ring 36 secured thereto. If desired, a gasket (not shown) may be provided between the second outer surface 43*a* of the lid 40 and the upper flange 31 of the float stand 30 to prevent the passage of air therebetween, as will be explained below. Similarly, the fourth outer surface 45*a* of the lid 40 abuts and is supported by the intermediate flange 33 of the float stand 30. A gasket (not shown) may be provided between the fourth outer surface 45*a* of the lid 40 and the intermediate flange 33 of the float stand 30 to prevent the passage of air therethrough, as will be explained below.

When the lid 40 is installed within the float stand 30, a fourth annular chamber 54 is defined between the third outer surface 44*a* of the lid 40 and the upper body portion 32 of the float stand 30. The fourth annular chamber 54 communicates with the canister 10 by means of the plurality of slots 32*a* formed through the upper body portion 32 of the float stand 30, as shown in FIG. 3. The fourth annular chamber 54 also communicates with the cylindrical chamber 50 by means of a first plurality of passageways 59 formed through the third outer and inner surfaces 44*a* and 44*b*, respectively, as shown in FIG. 3. The purpose of the fourth annular chamber 54 will also be explained below.

A conventional blower motor assembly, indicated generally at 60, is disposed within the lid 40. The blower motor assembly 60 includes an electric motor portion 61 and a fan portion 62. As is known in the art, the motor portion 61 can be activated to rotate the fan portion 62 to create a flow of air therethrough. The fan portion 62 of the blower motor assembly 60 abuts and is supported by the fourth inner surface 45*b* of the lid 40. An inlet (not shown) to the fan assembly 62 communicates with the cylindrical chamber 50. If desired, a gasket (not shown) may be provided between the fan portion 62 and the fourth inner surface 45*b* of the lid 40 to prevent the passage of air therebetween.

An annular air separator 63 is secured to the upper end of the blower motor assembly 60. The air separator 63 is preferably formed from a single piece of material, such as rotationally cast polyethylene. The air separator 63 extends outwardly from the blower motor assembly 60 into engagement with the second inner surface 43*b* of the lid 40. If desired, a gasket (not shown) may be provided between the air separator 63 and the second inner surface 43*b* of the lid 40 to prevent the passage of air therebetween. As will be explained below, the air separator 63 is provided to separate the flow of cooling air provided to the motor portion 61 from the flow of air created by the fan portion 62 to provide the desired vacuum effect for the floor cleaning device 10.

When the blower motor assembly 60 and the air separator 63 are installed within the lid 40, a fifth annular outlet chamber 55 is defined between them and the third inner surface 44*b*. An outlet (not shown) of the fan portion 62 of the blower motor assembly 60 communicates with the fifth annular chamber 55. The fifth annular chamber 55 communicates with the third annular chamber 53 defined within the lid 40 by means of a second plurality of passageways 55*a* formed through the third inner surface 44*b* of the lid 40. As mentioned above, the third annular chamber 53 communicates with both the smaller second annular chamber 52 and the larger first annular chamber 51. The first annular chamber 51 is vented to the atmosphere by means of a third plurality of passageways 57 formed through the upper surface 41 of the lid 40.

A hollow cover 70 is provided for closing the upper end of the lid 40 of the floor cleaning device 10. The cover 70 is also preferably formed from a single piece of material, such as rotationally cast polyethylene. The cover 70 defines an internal chamber 71 which is vented to the atmosphere by a plurality of openings 72 located about the periphery thereof. The internal chamber 71 also communicates through a central opening 73 with an inlet (not shown) for cooling air to pass through the motor portion 61 of the blower motor assembly 60. A sixth annular chamber 56 is defined between the air separator 63, the motor portion 61 of the blower motor assembly 60, and the cover 70. An outlet (not shown) of the motor portion 61 communicates with the sixth annular chamber 56. The sixth annular chamber 56 is also vented to the atmosphere by a fourth plurality of passageways 58 formed through first outer and inner surfaces 42*a* and 42*b*, respectively, of the lid 40.

The operation of the floor cleaning device 10 will now be described. When the blower motor assembly is activated, the motor portion 61 causes the fan portion 62 to rotate. Such rotation creates a vacuum in the cylindrical chamber 50, causing air to flow throughout the floor cleaning device 10. Such air flow enters the device 10 through the suction opening 21 and is deflected downwardly within the canister 20 by the deflector 22. The frusto-conical shape of the lower body portion 34 of the float stand 30 causes the incoming air to flow circumferentially about the canister 20. As a result, dirt, water, and other materials are separated from the air flow and deposited within the canister 20. The swirling air within the canister 20 eventually passes upwardly through the relatively narrow slots 32*a* into the fourth annular chamber 54 defined between the third outer surface 44*a* of the lid 40 and the upper body portion 32 of the float stand 30. The air passes downwardly through the fourth annular chamber 54, through the passageways 59, and into the cylindrical chamber 50.

The air in the cylindrical chamber 40 is then drawn through the inlet of the fan portion 62 of the blower motor assembly 60 and is discharged through the outlet into the fifth annular chamber 55 defined between air separator 63 and the third inner surface 44*b* of the lid 40. Next, the air passes through the relatively narrow passageways 55*a* into the third annular chamber 53, through the second annular chamber 52, and into the first annular chamber 51. As mentioned above, the volumes of the first and third annular chambers 51 and 53 are somewhat larger than the volume of the second annular chamber 52. Lastly, the air in the first annular chamber 51 is discharged to the atmosphere through the passageways 57.

At the same time the above described flow of air through the fan portion 62 of the blower motor assembly 60 is occurring, a separate flow of air is generated through the motor portion 61 thereof. Such separate air flow is provided to cool the motor portion 61 during operation. The cooling air flows through the peripheral openings 72 and into the chamber 71 defined within the cover 70. Then, the air passes through the central opening 73 and into the inlet of the motor portion 61. The air is discharged from the outlet of the motor portion 61 into the sixth annular chamber 56 defined between the air separator 63, the motor portion 61, and the cover 70. Lastly, the air is discharged from the sixth annular chamber 56 to the atmosphere through the passageways 58.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A floor cleaning device comprising:

a hollow canister having a closed end, an opened end, and a suction inlet;

a hollow lid mounted on said opened end of said hollow canister and having an interior which defines a first annular chamber, a second annular chamber, and a third annular chamber, said second chamber providing communication between said first and third chambers and being smaller in volume than said first and third chambers, said first chamber communicating with the atmosphere through a first passageway formed through said lid, an enclosed space being defined between said lid and said closed end of said hollow canister; and a blower motor assembly mounted on said lid and operative to draw air through said suction inlet and said enclosed space, said blower motor assembly operative to exhaust air through said third chamber, said second chamber, and said first chamber to the atmosphere.

2. The floor cleaning device defined in claim 1 further including a float stand mounted on said opened end of said canister, said enclosed space being defined between said float stand and said closed end of said canister, said hollow lid being mounted on said float stand.

3. The floor cleaning device defined in claim 2 wherein a fourth chamber is defined between said lid and said float stand, said fourth chamber communicating with said enclosed space through a passageway formed through said float stand and with said blower motor assembly.

4. The floor cleaning device defined in claim 3 wherein an inlet chamber is defined between a first portion of said blower motor assembly and said lid which communicates with said fourth chamber through a second passageway formed through said lid.

5. The floor cleaning device defined in claim 4 wherein an outlet chamber is defined between a second portion of said blower motor assembly and said lid which communicates with said third chamber defined in said lid through a third passageway formed through said lid.

6. The floor cleaning device defined in claim 1 further including means for deflecting the flow of air through said suction inlet downwardly into said closed end of said canister.

7. The floor cleaning device defined in claim 1 further including means for selectively preventing the flow of air out of said enclosed space into said blower motor assembly.

8. The floor cleaning device defined in claim 1 further including a cover disposed over said lid and said blower motor assembly.

9. A floor cleaning device comprising:

a hollow canister having a closed end, an opened end, and a suction inlet;

a float stand mounted on said opened end of said canister, an enclosed space being defined between said float stand and said closed end of said canister;

a hollow lid mounted on said float stand and having an interior which defines a first chamber, a second chamber, and a third chamber, said second chamber providing communication between said first and third chambers and being smaller in volume than said first and third chambers, said first chamber communicating with the atmosphere through a first passageway formed through said lid, a fourth chamber being defined between said lid and said float stand, said fourth chamber communicating with said enclosed space through a passageway formed through said float stand; and a blower motor assembly mounted on said lid, an inlet chamber being defined between a first portion of said blower motor assembly and said lid which communicates with said fourth chamber through a second passageway formed through said lid, an outlet chamber being defined between a second portion of said blower motor assembly and said lid which communicates with said third chamber defined in said lid through a third passageway formed through said lid, said blower motor assembly operative to draw air through said suction inlet, said enclosed space, said fourth chamber, and said inlet chamber, said blower motor assembly operative to exhaust air through said outlet chamber, said third chamber, said second chamber, and said first chamber to the atmosphere.

10. The floor cleaning device defined in claim 9 further including means for deflecting the flow of air through said suction inlet downwardly into said closed end of said canister.

11. The floor cleaning device defined in claim 9 further including means for selectively preventing the flow of air out of said enclosed space into said blower motor assembly.

12. The floor cleaning device defined in claim 9 further including a cover disposed over said lid and said blower motor assembly.

* * * * *